United States Patent [19]

Ketteler et al.

[11] 4,181,269

[45] Jan. 1, 1980

[54] REELING DEVICE FOR VENEER BAND

[75] Inventors: Otto Ketteler, Bad Iburg; Hans-Peter Gielsok, Mettingen, both of Fed. Rep. of Germany

[73] Assignee: C. Keller GmbH u. Co. KG, Ibbenbüren, Fed. Rep. of Germany

[21] Appl. No.: 916,620

[22] Filed: Jun. 19, 1978

[51] Int. Cl.[2] ..... B65H 17/08; B65H 17/14

[52] U.S. Cl. ..... 242/65; 242/75.1

[58] Field of Search ..... 242/67.1 R, 67.2, 67.3 R, 242/65, 66, 75.1, 75.2, DIG. 3

[56] References Cited

U.S. PATENT DOCUMENTS

| | | | |
|---|---|---|---|
| 1,959,418 | 5/1934 | Fourness | 242/67.1 R X |
| 2,939,645 | 6/1960 | Rowlands et al. | 242/66 X |
| 3,776,482 | 12/1973 | Mras | 242/67.1 R |

FOREIGN PATENT DOCUMENTS

| | | | |
|---|---|---|---|
| 2424911 | 1/1976 | Fed. Rep. of Germany | 242/67.1 R |

*Primary Examiner*—Harvey C. Hornsby
*Assistant Examiner*—John M. Jillions
*Attorney, Agent, or Firm*—Frank J. Jordan

[57] ABSTRACT

Apparatus for reeling sheet material on a roll includes first pivoting arms pivotably mounted for rotation about an axis coincident with the axis of the roll, second pivoting arms having one end portion pivotably mounted on the first pivoting arms, and chain pressing means suspended from the other end portion of the second pivoting arms, the first pivoting arms being pivotable between an inoperable position which permits the roll to be mounted or removed from the mounting means and an operable position in which the chain pressing means extends about the roll to contact the veneer sheet material on the roll and thereby facilitate reeling of the veneer sheet material on the roll. Endless band means are movable into a position to contact the veneer sheet material on the roll during the reeling operation to also facilitate reeling of the veneer sheet material on the roll.

9 Claims, 5 Drawing Figures

REELING DEVICE FOR VENEER BAND

BACKGROUND OF THE INVENTION

The invention relates to a device for the reeling of veneer sheeting with a guiding device pivotable into a switching-off position and consisting of pressing devices, the pressing devices comprising roller chains disposed at parallel and spaced distances from each other, the roller chains encircling the enlarging reel during the entire reeling process.

DT-AS No. 24 24 911 describes a similar device having a guiding device pivotal to a switching-off position and consisting of feeding devices utilizing sprocket chains, the feeding devices lying at parallel spaced distances from each other and being connected to each other, the sprocket chains encircling the enlarging reel during the entire reeling process. The feeding devices are fastened at one end to a cross tie rod disposed at a stationary position within the area of the friction roller and at their other end to arms which are horizontally movable within a device unit. The feeding devices surround a guide shaft which is connected to the piston of a piston-cylinder-unit. Furthermore, the feeding units are led over two guide axles. A weight provides tension for the feeding devices.

This known device is extremely expensive and prone to interruption due to the device unit and the piston-cylinder-units used because the feeding devices upon the guide rod may jam during the reeling process. Furthermore, a free space, a so-called feeding gusset, remains between the friction roller and the feeding devices fastened to the cross tie rod which cannot be bridged by the feeding devices. Frequently breaks occur and bending and buckling of the veneer sheeting results. The whole device must be stopped at once in order to remove these breaks and bucklings. If this is not done extensive damages to the veneer sheet cannot be prevented.

SUMMARY OF THE INVENTION

An object of the present invention is to provide a device for the reeling of veneer sheeting which requires lower costs of investment and which excludes damages to the veneer sheeting during reeling and allows a fast and uninterrupted working process and thus a large output.

In order to achieve this object the present invention provides pressing devices which are fastened at their one end to the free end of pivotal arms fulcrumed on an axle and having the other end hanging freely downwardly, the axle being supported at the free end of two pivotable cross pieces disposed at a distance from each other, and that furthermore, the device consists of endless wrap around bands disposed at spaced distances from each other and parallel to each other, the wrap around bands covering the wrap around area of the reel which is not contacted by the pressing devices.

In an additional aspect of the invention the wrap around bands are guided around three guide shafts arranged in a triangle and the guide roll disposed at the apex of the triangle is connected at both sides to levers moving the guide shafts, the levers being fastened by metal plates to a cross tie.

The advantages obtained by the invention are particularly that the weight of the device is small, that the device is simple and simply produced, and that it needs practically no upkeep. Furthermore, the embodiment of the invention prevents damages to the veneer sheet during reeling because the so-called feeding gusset is obviated by the arrangement of the wrap around bands. The veneer is treated very gently because no pull is exerted on the pressing means and because the pressure caused by the weight of the pressing means results from their lying against the veneer reel that is enlarging.

Additional advantages, characteristics, and details of the present invention will be discernible from the following description of an embodiment and also by aid of the drawing, as follows:

BRIEF DESCRIPTION OF THE DRAWINGS

FIG. 2 is a side elevation of a section of the device with the spool brought in.

DESCRIPTION OF THE PREFERRED EMBODIMENTS

Figure 1:
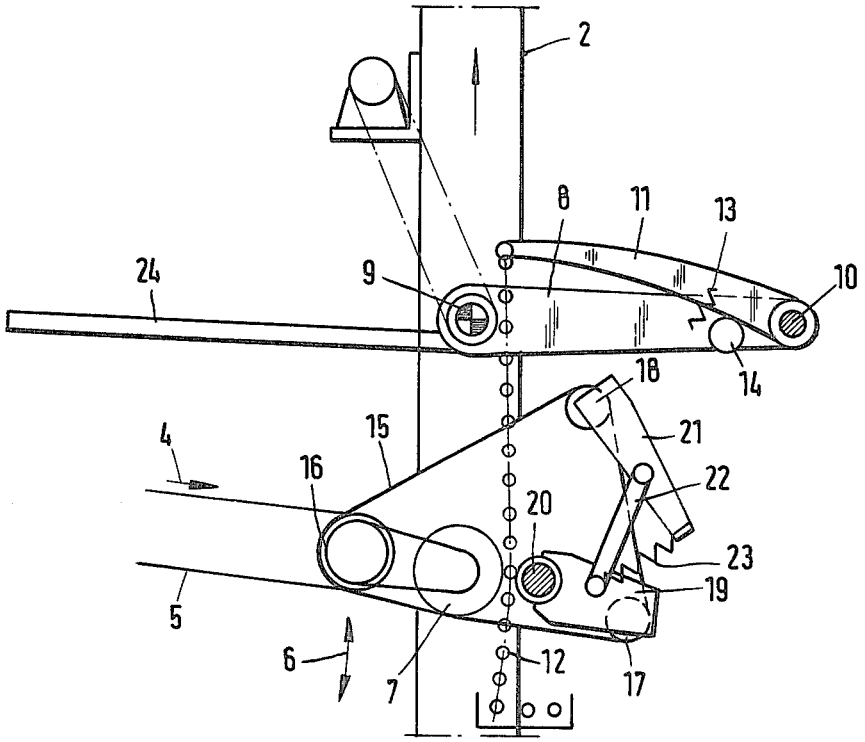
FIG. 1 is a side elevation of a section of the device when not in use.

A spool 1 is supported by a machine frame 2 and rotates in the direction of the arrow 3. A conveyor belt 5 moving in the direction of the arrow 4 feeds a veneer sheet. The conveyor belt 5 may be formed as a conveyor table whose height may be regulated in the direction of the arrows 6 by a pivoting motion, for example, while reeling in order to accommodate the enlarging reeling diameter of the spool 1. At the end of the conveyor belt 5 there is provided a friction roller 7 which is driven by an appropriate drive and which in turn rotates the spool 1. The friction roller 7 is pressed by spring action or by a counter weight against the spool 1 at the same time with the conveyor belt 5.

The device for reeling and unwinding of the veneer sheet consists of two arms 8, each disposed at one side of the spool 1, and having pivotal axes located at the center of the rotational axle 9 of the spool 1. Both arms 8 are connected at their free ends by an axle 10.

Figure 3:
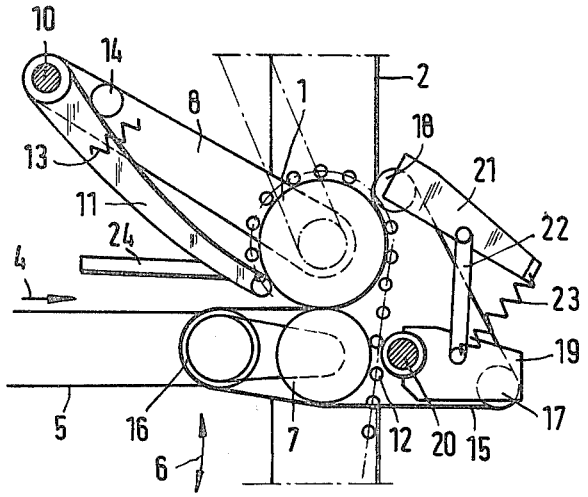
FIG. 3 is a side elevation of a section of the device shortly prior to start-up.

Two pivoting arms 11 or several of them, according to the length of the veneer, are pivotably supported upon the axle 10. On each free end of the pivoting arms 11 pressing means 12 in the shape of roller chains are fastened, hanging freely downwardly. The pivoting arms 11 are held in the direction of the feeding arms 8 by a spring 13, while the pivoting arms 11 abut against a connecting pipe 14 which is fastened between the feeding arms 8 and is eccentrically movable. The eccentric regulation of the connecting pipe 14 permits adjustment of the height of the pivoting arms 11 when the arms 11 are led around the spool as shown in FIG. 3.

The feeding arms 8 are connected to a geared motor by means of stub shafts, sprocket wheels and a synchronization shaft. The geared motor actuates the pivoting of the feeding arms 8 and the pivoting arms 11, connected to the feeding arms, into the operating position and into the switched-off position.

Another part of the device for reeling and unwinding of veneer sheeting are a plurality of narrow wrap around bands 15 disposed at distances from each other. The endless wrap around bands 15 are disposed around three triangularly disposed guide shafts, 16, 17 and 18, and the guide shaft 16 mmoves the wrap around bands 15, the guide shaft 16 simultaneously acting as the guide shaft for the conveyor belt 5. The guide shaft 17 is carried by the metal plates 19 disposed at both ends of guide shaft 17 and the metal plates are fastened to a cross tie 20.

The cross tie 20 is connected to the conveyor belt 5 and moves with the conveyor belt 5 in the direction of the arrows 6. The guide shaft 18 is carried by the levers 21 and 22 which are disposed at both ends of the guide shaft 18. The levers 22 are connected to the levers 21 and the metal plates 19 respectively in such a manner that the cooperable levers 21 and 22 function similar to an articulated hinge. The springs 23 attached to the levers 21 and the metal plates 19 operate so that the articulated hinge or the levers 21 and 22 respectively tend to pivot into a stretched position. Consequently, the wrap around bands 15 stretch over the guide shaft 18 or the wrap around bands accommodate to the steadily enlarging reel, respectively.

The device operates as follows:

FIG. 1 shows the starting position. The feeding arms 8 and the pivoting arms 11 are pivoted to an off position and the friction roller 7 also rests in a lower, pivoted-off position. An empty spool 1 may now move in along the guide structure 24 onto the rotary axle 9.

Figure 2:
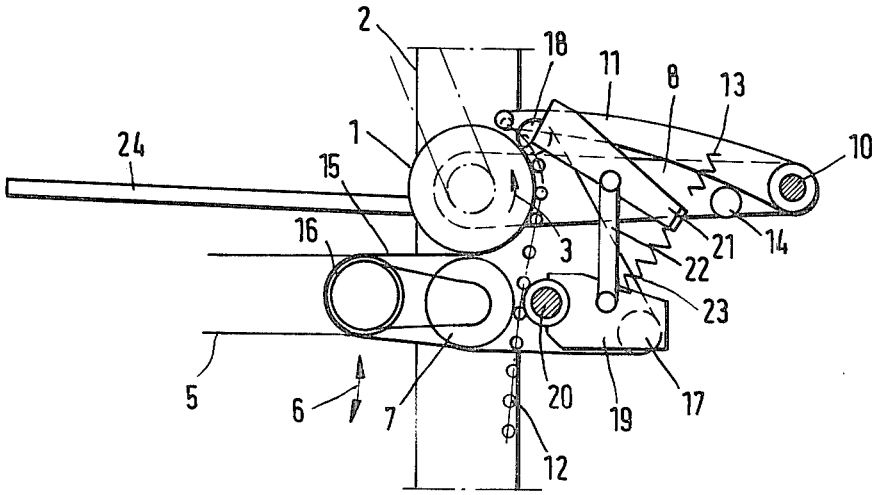

As soon as that has happened, the friction roller 7 moves towards the spool 1 and the wrap around bands 15 automatically close around the spool 1. The pivoting arms 11 with the pressing means 12 also abut the spool 1 (FIG. 2).

Consecutively the feeding arms 8 pivot to the operating position around the rotary axle 9 through a rotary angle of about 150° and pivot also simultaneously the pivoting arms 11 in the reeling position. Due to the force of the spring 13, the ends of the pivoting arms 11 lie close to the spool 1 and pull, while pivoting, the pressing means 12 around the spool 1, the pressing means 12 hanging down due to their own weight. Consequently, the pressing means 12 also closingly abut the spool 1. After this process the spool 1 is enclosed around almost all of its circumference by the pressing means 12 and the wrap around bands 15 (FIG. 3).

Figure 4:
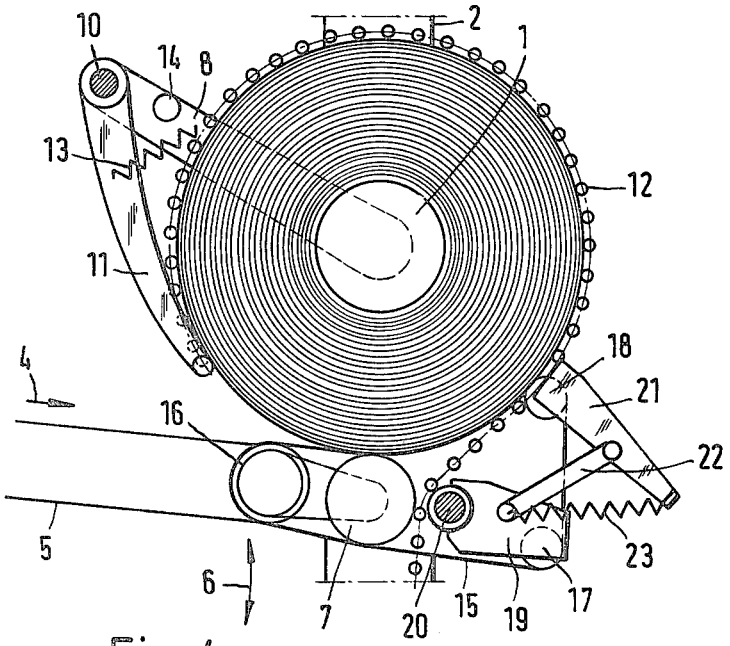
FIG. 4 is a side elevation of a section of the device with a spool filled with a veneer sheet.

While the roll enlarges the friction roller 7 moves downwardly, the friction roller 7 being pressed unto the roll by counter weights. This causes the wrap around bands also to conform to the roll. The pivoting arms 11 are also pivoted with an increasing angle, the pivoting arms abutting the roll due to the weight of the feeding means and aided by the spring 13. The position of the shaft 10, the fulcrum of the pivoting arms 11, is chosen in such a manner that the free ends of the pivoting arms 11 move with the guide points of the pressing means 12 on the pivoting arms 11 in such a circular path that the wrap around angle is bound to stay constant from the start of the reeling process to the end of the reeling process (FIG. 4).

Figure 5:
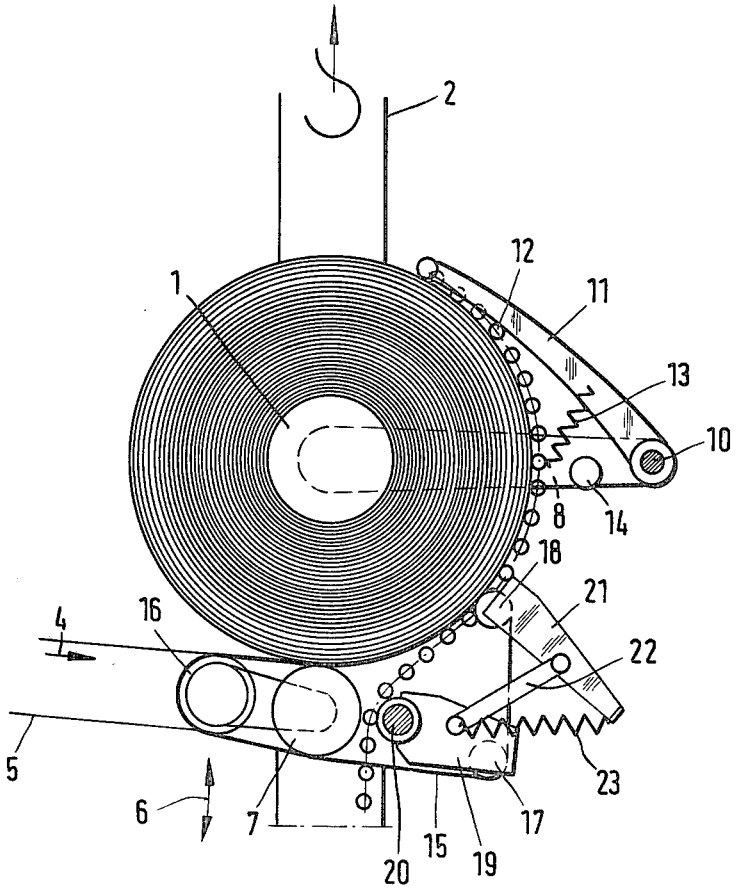
FIG. 5 is a side elevation of the device with the spool filled with a veneer sheet shortly before removing the reel.

Once the reeling process is over, the feeding arms 8 pivot back in their starting position. The pivoting arms 11 with the pressing means 12 still abut the roll in this position (FIG. 5).

The spool 1 with the roll is now lifted vertically out of the reeling position in the machine frame 2 and taken away. That causes a slight lifting of the pivoting arms 11 which slide along the roll and then fall into the starting position due to their own weight. Before that the friction roller 7 with the wrap around bands 15 has been pivoted downwardly so that one may move in a new spool and restart a new reeling operation (FIG. 1).

We claim:

1. Apparatus for reeling sheet material on a roll, comprising means for rotatably mounting said roll, first pivoting arms pivotably mounted for rotation about an axis coincident with the axis of the roll, second pivoting arms having one end portion pivotably mounted on said first pivoting arms, chain pressing means suspended from the other end portion of said second pivoting arms, said first pivoting arms being pivotal between an inoperable position which permits the roll to be mounted or removed from said mounting means and an operable position in which said chain pressing means extends about the roll to contact the veneer sheet material on the roll and thereby facilitate reeling of the veneer sheet material on the roll, and endless band means movable into a position to contact the veneer sheet material on the roll and to maintain said contact during the reeling operation to facilitate reeling of the veneer sheet material on the roll.

2. Apparatus according to claim 1 further comprising biasing means between said first and second pivoting arms biasing said second pivoting arms in one pivotal direction relative to said first pivoting arms, stop means on said first pivoting arms against which said second pivoting arms are biased by said biasing means when said first pivoting arms are in said inoperable position.

3. Apparatus according to claim 2 further comprising means for pivoting said first pivoting arms between said inoperable and said operable positions, said chain pressing means hanging freely from said second pivoting arms when said first pivoting arms are in said inoperable position, said chain pressing means passing over said roll when said first pivoting arms are in said operable position such that the weight of the chain pressing means contacts the veneer sheet material on the roll during the reeling operation to facilitate reeling of the veneer sheet material on the roll.

4. Apparatus according to claim 3 whereby when said first pivoting arms are in said inoperable position, said chain pressing means hangs freely from said second pivoting arms on one side of a vertical plane passing through the axis of rotation of said roll, and whereby when said first pivoting arms are in said operable position, a first portion of the chain pressing means is wrapped around the upper portion of the roll to extend to a position on the other side of said vertical plane and a second portion of the chain pressing means hangs freely on said one side of said vertical plane.

5. Apparatus according to claim 1, wherein said endless band means comprises an endless band movable about first, second and third guide shafts having their axes disposed parallel to one another and spaced from one another in a triangular configuration, said guide shafts being disposed such that a run of the endless band between said first and second guide shafts contacts the veneer sheet material on the roll during the reeling operation to facilitate reeling of the veneer sheet material on the roll.

6. Apparatus according to claim 5, wherein said endless band means further comprises spring means for biasing said second guide shaft to provide for displacement of said second guide shaft relative to the roll so that said endless band means accommodates to the steadily enlarging roll of sheet material during the reeling operation.

7. Apparatus according to claim 6 further comprising a conveyor means for feeding said veneer sheet material to said roll, said conveyor means having an adjustable height to accommodate the enlarging roll diameter during the reeling operation of the sheet material, a friction roll mounted on said conveyor means operable to engage the veneer sheet material on the roll and to rotate the latter during the reeling operation.

8. Apparatus according to claim 7, wherein said first guide shaft is mounted on said conveyor means.

9. Apparatus according to claim 6, wherein said third guide shaft is rotatably mounted on support plates, first levers for supporting said second guide shaft, second levers pivotably mounted on said support plates for pivotally supporting said first levers, said spring means extending between said first levers and said support plates for biasing said first and second levers in a position which urges said second guide shaft against the veneer sheet material on the steadily enlarging roll during the reeling operation.

* * * * *